US005372258A

United States Patent [19]

Daneshvar

[11] Patent Number: 5,372,258

[45] Date of Patent: Dec. 13, 1994

[54] PILL SAMPLE ILLUSTRATOR, AND WEEKLY MEDICINE BOX

[76] Inventor: Yousef Daneshvar, 21459 Wood Farm, Northville, Mich. 48167

[21] Appl. No.: 959,647

[22] Filed: Oct. 13, 1992

Related U.S. Application Data

[63] Continuation-in-part of Ser. No. 932,562, Aug. 20, 1992.

[51] Int. Cl.[5] ..... B65D 83/04

[52] U.S. Cl. ..... 206/534; 40/324; 206/539

[58] Field of Search ..... 206/534, 538, 539, 532; 116/308; 40/324

[56] References Cited

U.S. PATENT DOCUMENTS

| | | | |
|---|---|---|---|
| 2,953,242 | 9/1960 | Shaw | 206/534 |
| 3,003,273 | 10/1961 | Tapper | 40/324 X |
| 3,225,913 | 12/1965 | Lee | 206/539 X |
| 4,039,080 | 8/1977 | Cappuccilli | 206/534 |
| 4,473,156 | 9/1984 | Martin | 206/534 |
| 4,593,819 | 6/1986 | Will | 206/538 |
| 4,693,371 | 9/1987 | Malpass | 206/538 |
| 4,889,237 | 12/1989 | Brandon | 206/534 |
| 5,069,332 | 12/1991 | Williams et al. | 206/6.1 |
| 5,174,451 | 12/1992 | Niven | 206/534 |

FOREIGN PATENT DOCUMENTS

| | | | |
|---|---|---|---|
| 1012508 | 12/1965 | United Kingdom | 206/539 |

*Primary Examiner*—Bryon P. Gehman

[57] ABSTRACT

A pill sample illustrator has a two rectangular, transparent plastic sheets that come together to enclose pill samples and a medical chart. These sheets provide a single row of individual pill sample receiving spaces for the pill samples along one side of the illustrator and a larger adjacent space for the medical chart. The medical chart contains bands extending from the pill sample receiving spaces to the opposite side of the illustrator. Each band contains indicia for relating to a pill sample in a corresponding one of the pill receiving spaces. The pill sample illustrator also forms a lid for a box that contains supplies of the pills that are to be taken by a patient.

19 Claims, 17 Drawing Sheets

111

| | |
|---|---|
| ○ | LANOXIN=HEART PILL. 0.125mg ONE A DAY |
| ▭ | MICRO.K.10 POTASSIUM 850mg ONE 3 TIMES A DAY WITH FOOD |
| ○ | LASIX WATER PILL 40mg ONE A DAY IN MORNING |
| ⬡ | MAVACOR 10mg FOR HIGH CHOLESTEROL TAKE ONE A DAY WITH SUPPER |
| ⬠ | VASOTEC FOR BLOOD PRESSURE 5mg ONE A DAY |
| QUESTRAN | POWDER FOR CHOLESTEROL. ONE SCOOP TWICE A DAY |
| INSULIN REGULAR | FOR HIGH SUGAR. 10 UNITS IF BLOOD SUGAR OVER 400. LISTEN TO TAPE |
| | |

134

PILL SAMPLE ILLUSTRATOR, AND WEEKLY MEDICINE BOX

REFERENCE TO A RELATED APPLICATION

This application is a continuation-in-part of my copending application Ser. No. 07/932,562 filed Aug. 20, 1992.

BACKGROUND OF THE INVENTION

This invention arises from my observation that many of my patients have had problems with remembering dosages of and directions for medications that I had prescribed for them. I have noted that some of my patients, especially older ones, have had significant difficulty in remembering new orders and directions, which are very important and critical, and that a mistake could cause major side effects for them as well as a problem for the doctor. My observations have led to a solution which is emb6died in the present invention and which I truly believe is unique and very useful.

My invention is basically a box that is designed to conveniently hold medications, allowing the person to conveniently carry the medications, to easily see samples of the medications, and to listen to directions of the physician many times over. I believe this will help in preventing worry, bad feelings, and discomfort in patients, and that is what I work for.

The modification of my previous invention came from my further observation that many of my patients had problems with remembering the doses and directions of medication which I had ordered for them and also because they were not able to identify which medicine was which. In fact, in one case recently, I had a hard time to find out the nature of one pill. The main idea that I had presented before is now allowed to be used as a separate part. This invention greatly helps patients recognize the names and dosages of the medication, and associate them with each other, etc. It will also help the medical staff and family members to help the patient in her medicine. I also present an improved version of "weekly medicine box" that will be in many ways a better product to help patients not only identify the name, nature, and dosage of the medication, but also to have a supply of one week of those medications as well as picking them up easily with a scoop and hopefully open the box easily. Also, they will use a previously explained system to help patients avoid mixing one day's medication with another's when each day's medication has a special door by itself.

SUMMARY OF THE INVENTION

My invention is based on a very useful basic device: a box. I provide the box with clear windows in its sides and top for insertion of photos or written materials, directions, instructions, etc., and also with either a place for a cassette recorder and player (herein sometimes referred to as record player or recorder), or a record player fixed to its wall, that allows tapes to be heard conveniently. While I believe that this device has many uses in many ways, for example in educational purposes of many kinds, one particular good use of this box is as a medical box of about lunch box size to hold medications of a patient inside it.

This box can be made from plastic or synthetic materials, such as brief case materials. In the case of a medical box, it can have a soft layer of sponge on the inside of its bottom wall to allow medication bottles to sit on it easily. The box can be divided into small spaces with the use of plastic dividing walls of about 1.5 to 2 mm thick whose ends slide into small depressions, or slots, in the walls. Many of these slots are provided in the box's walls to allow the distances between the dividing walls to be adjustable in order for the spaces between them to be easily adjusted. An inner lid of the box is a clear plastic having spaces that can hold pills, and adjacent the pill spaces, a sheet, such as my "Medical Chart" containing their directions. A space is also provided in the inner lid to allow a booklet, such as my "Medical Passport", to be inserted. The box thereby allows a patient: to store his or her medications inside the box; to see samples of tablets in the clear plastic spaces and also read the name and directions of the medications easily; and to record the directions for medications in the doctor's office and later listen to the directions and advice of the medical profession or of the patient's family.

The medical box also contains a "weekly pill box" that is designed to hold medications for one week and to help the patient plan and use them much more easily and to eliminate the need for the patient to open individual medication bottles each time he or she has to take a pill. The "weekly pill box" is conveniently arranged inside the medical box. I believe that my invention is a very useful tool that will help patients as well as their families in many ways.

This invention combines several useful ideas to make a patient recognize her pills and see the dosages and also introduces a very useful weekly medicine box that holds the medicine for one week. The first part is made from a combination of two sheets of clear plastic that are almost a mirror image of each other. To one side (the right), a flat narrow space is designed that will hold a thick sheet of paper. These two sheets of plastic (identified here as upper sheet=A and lower sheet=B) are hinged along the rear and can be folded over each other and be kept tight with the use of small snaps, rubber bands, or a spring attached to one side to go over the other side, etc. They have small spaces to hold one pill in each one, plus one or two sheets of information or pictures can be held between them. One is called "Medicine chart". The other can be a picture, important telephone numbers, etc. This medicine chart will supply information about the name and nature of the pill, directions and dosages, and it will be placed in the flat space in front of the pill's place to let the person associate each pill with the help of colors and lines with its directions and specifications. I believe this unit can be a very useful part by itself; and a patent will be requested on it.

This unit can also be modified to make a door for a box that can hold the medication for one week in its twenty-eight small boxes. This weekly medicine box is made from a flat box that will be divided by three horizontal and six vertical walls to divide it into a total of twenty-eight small boxes. In other words, there will be seven columns of boxes: each one for one day's medication, each one divided in four parts to allow the morning, noon, afternoon, and evening medication to be placed.

The small boxes are designed to have a curve in the bottom like a ski slope to allow the pills to be removed with a small scoop so that it will not hurt the patient's fingers. The door may be closed by the use of two pieces of magnet in each end plus with one or more rubber/elastic bands that will be attached to the back or sides to go around the box and lid to hold the box closed. The rubber band may also be attached to the lid and pulled to go over a hook on the box or vice versa. To make the opening of the box and its closing simpler, or a spring to go from one side to another. Also, the usual latches may be used for this purpose. The handles on the upper lid may be large to allow easy opening and in the bottom there may be a part to allow holding the bottom part. A clear window in its bottom will allow insertion of photos or written materials, directions instructions, etc. . . .

Another model will use the idea of having individual small doors to cover each day's medication (presented in previous application). Then, after the one day's medication is finished, it will cover the door of the previous day's box. This will allow only one day's medication to be opened each time. And overall, this will make a much better and useful way to have the medication available for the patients. The incorporation of these features to the medicine box mentioned in the previous application will make much better units.

DESCRIPTION OF THE PREFERRED EMBODIMENT

Figure 1:
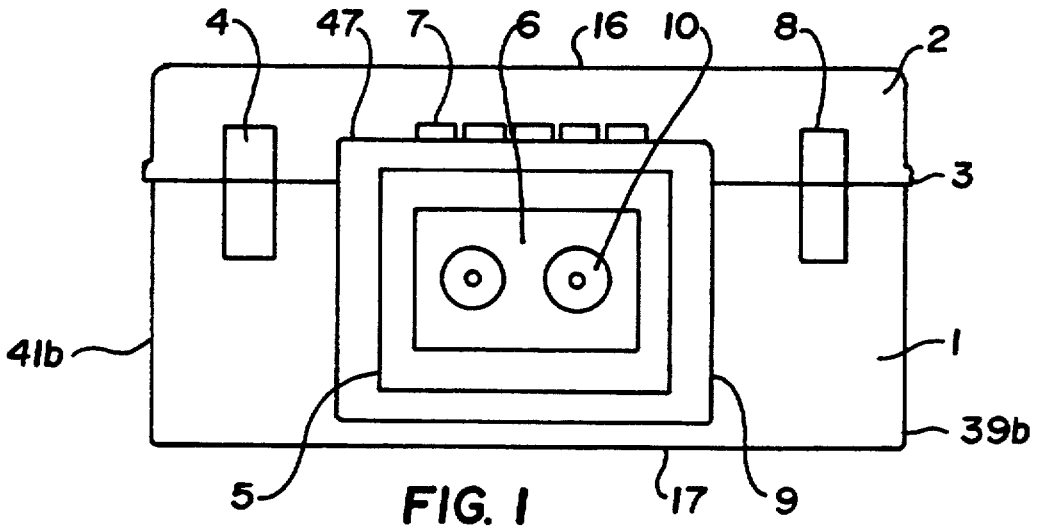
FIG. 1 is a front elevational view of a medical box according to the present invention.
Figure 2:
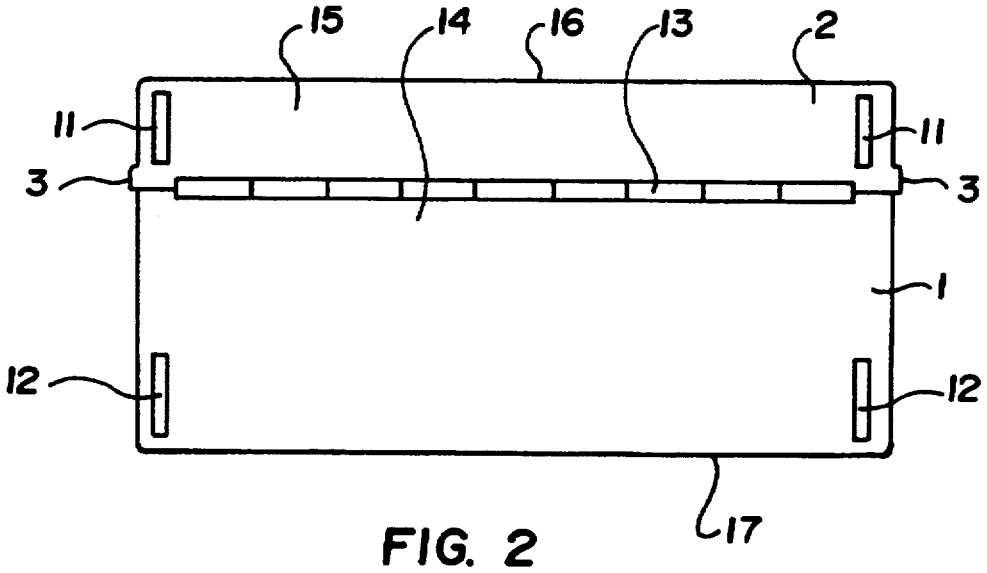
FIG. 2 is a rear elevational view of the medical box.
Figure 3:
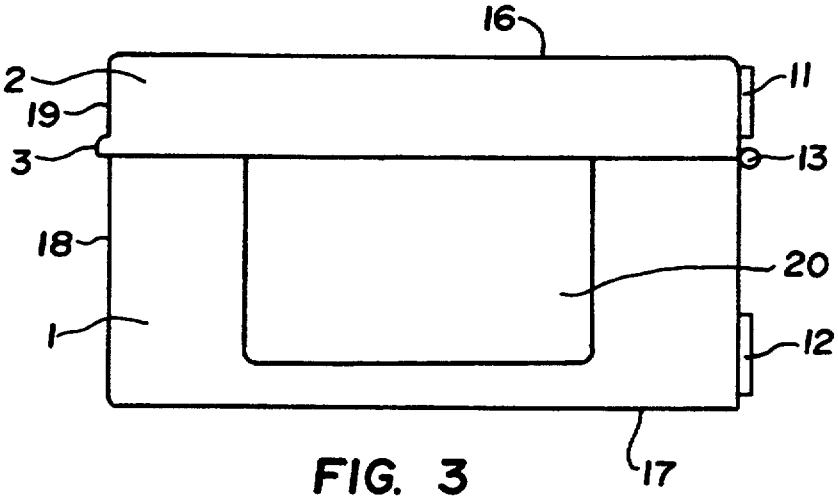
FIG. 3 is a right side elevational view of the medical box.

FIGS. 1–11 show the general organization and arrangement of the medical box. The medical box comprises a body 1 in the form of a generally rectangular container having a base, or bottom wall, 17, a front wall 18, a back wall 14, a right side wall **39*b*, and a left side wall 41*b*. It also comprises a generally rectangular shaped upper, or outer, lid 2 having a top, or upper wall 16, a front wall 19, and a back wall 15. It also has a lower edge 3 that overlaps the upper edge of body 1 when in closed position as shown in FIGS. 1–3 and 8. The back of lower edge 3 is connected by means of a hinge 13 with the upper edge of back wall 14 so that upper lid 2 can be swung open, as in the manner of FIG. 9. Conventional left and right snaps 4 and 8 are at the front of the medical box. Reference numeral 9 designates the place at the front center of the medical box for a cassette recorder 47 which comprises a door 5, and a window 6, and which contains a reel of tape 10. The upper part of cassette recorder 47 contains control buttons 7. The back of the medical box contains two small upper bases 11 and two small lower bases 12** for steady support of the medical box, if laid on its back.

Figure 4:
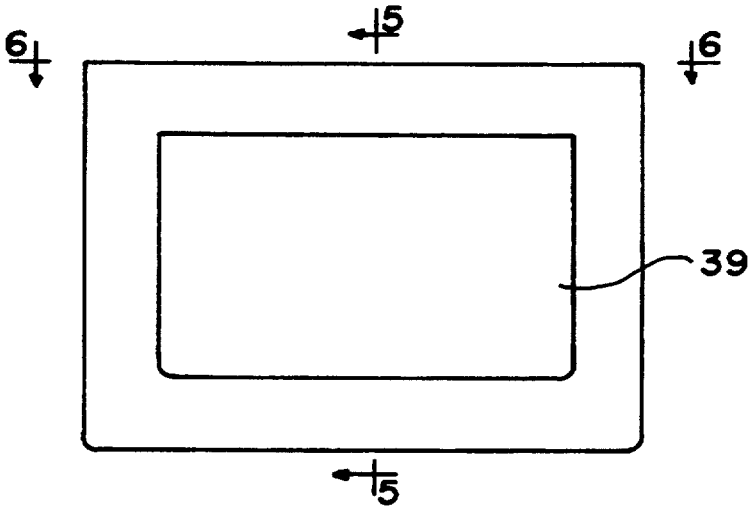
FIG. 4 is a right side elevational view of the medical box with the lids having been removed for illustrative purposes.
Figure 5:
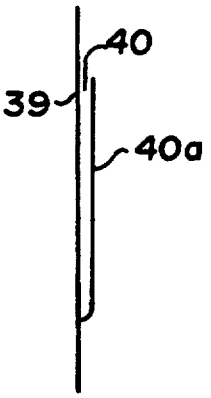
FIG. 5 is a vertical cross-sectional view in the direction of arrows 5—5 in FIG. 4.
Figure 6:
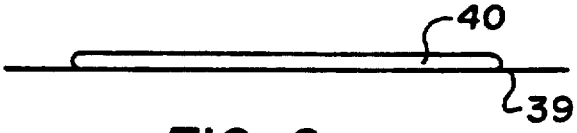
FIG. 6 is a top view taken in the direction of arrows 6—6 in FIG. 4.
Figure 7:
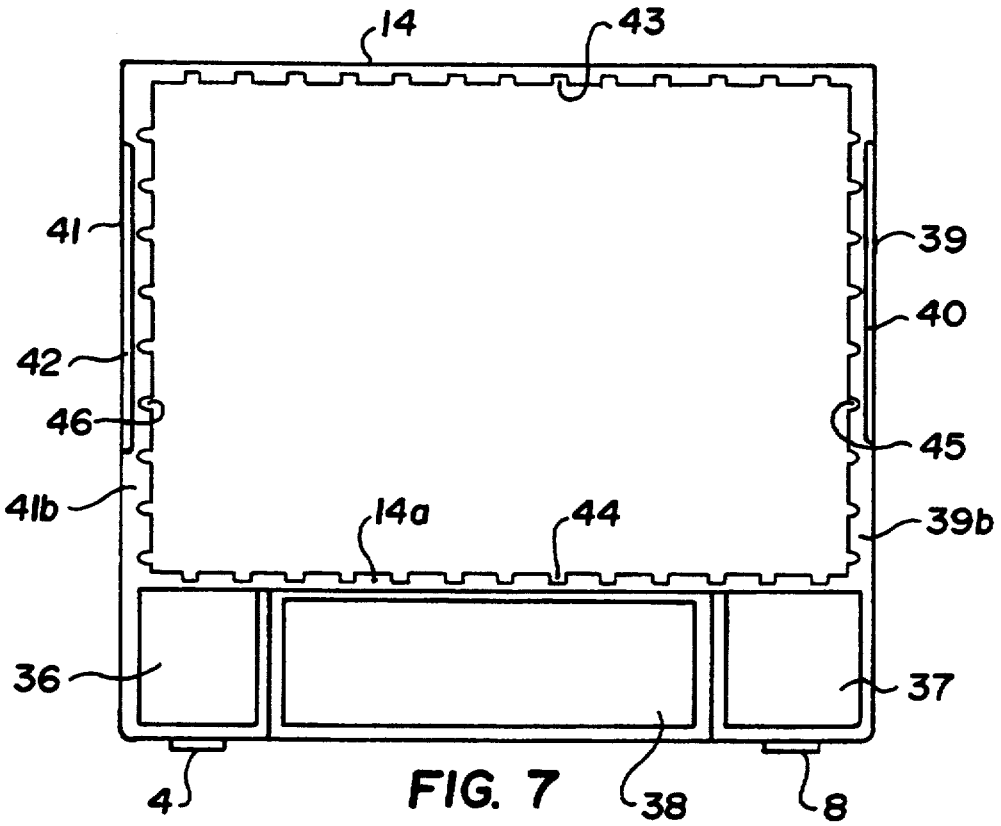
FIG. 7 is a top plan view of the main body of the medical box by itself.

FIG. 7 shows that each side wall **39*b*, 41*b* contains a corresponding clear plastic window 39, 41 designed for placement of printed materials, pictures, etc. FIGS. 4–6 show further detail relevant to window 39. A plastic back wall 40*a* cooperates with window 39 to provide a space 40 into which printed materials can be inserted. FIG. 7 also shows a space 38 for cassette recorder 47 and two spaces 36, 37 to either side of space 38 for insertion of special medication, such as eye drops or nitroglycerin tablets. The reference numeral 42 designates a space behind window 41**.

The main space of body 1 is between back wall 14 and a wall **14*a* that is behind space 38. Vertical depressions, or slots, 43, 44, 45, 46 respectively are in walls 14, 14***a*, 39*b*, 41*b* respectively.

Figure 8:
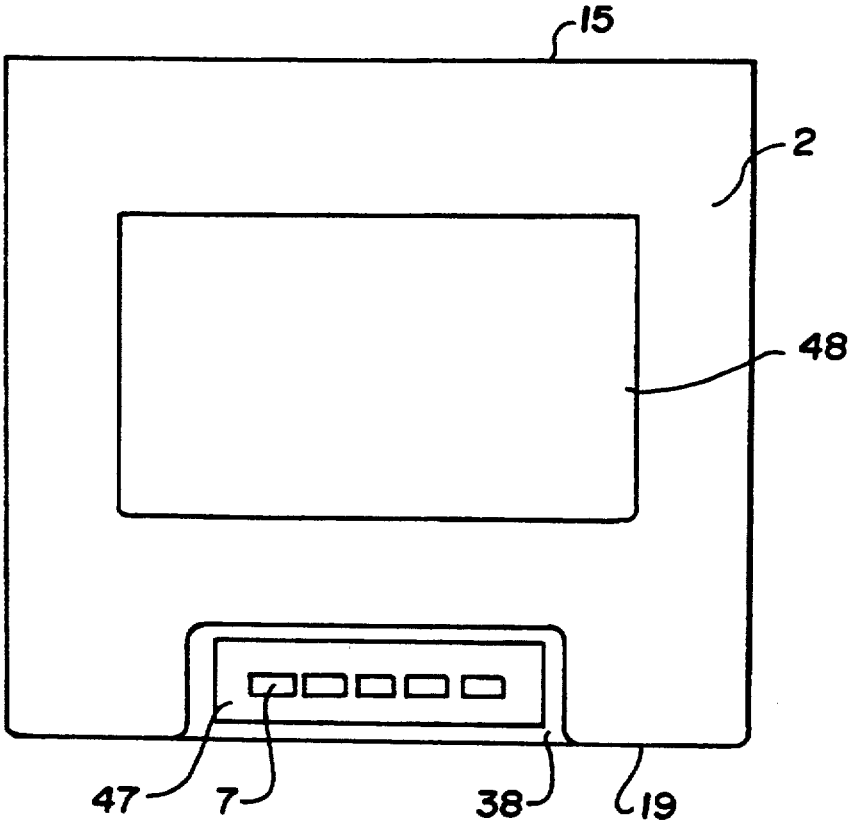
FIG. 8 is a top plan view of the medical box with the lids closed.

FIG. 8 shows a clear window 48 in the center of upper lid 2. When upper lid 2 is opened about 90 degrees as in FIG. 9, two plastic walls A and B can also be swung open. The reference numeral 16 refers to the upper wall of upper lid 2; and the reference numeral 28, to the lower edge of upper lid 2.

Figure 9:
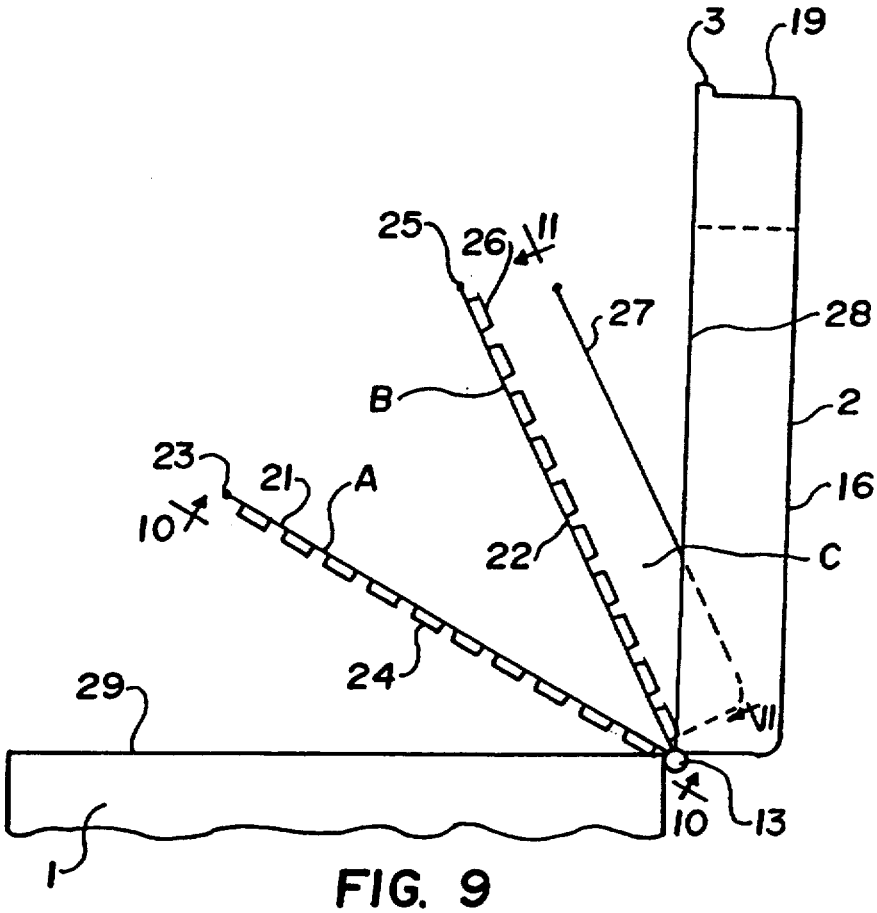
FIG. 9 is a fragmentary right side elevational view with the lids open.
Figure 10:
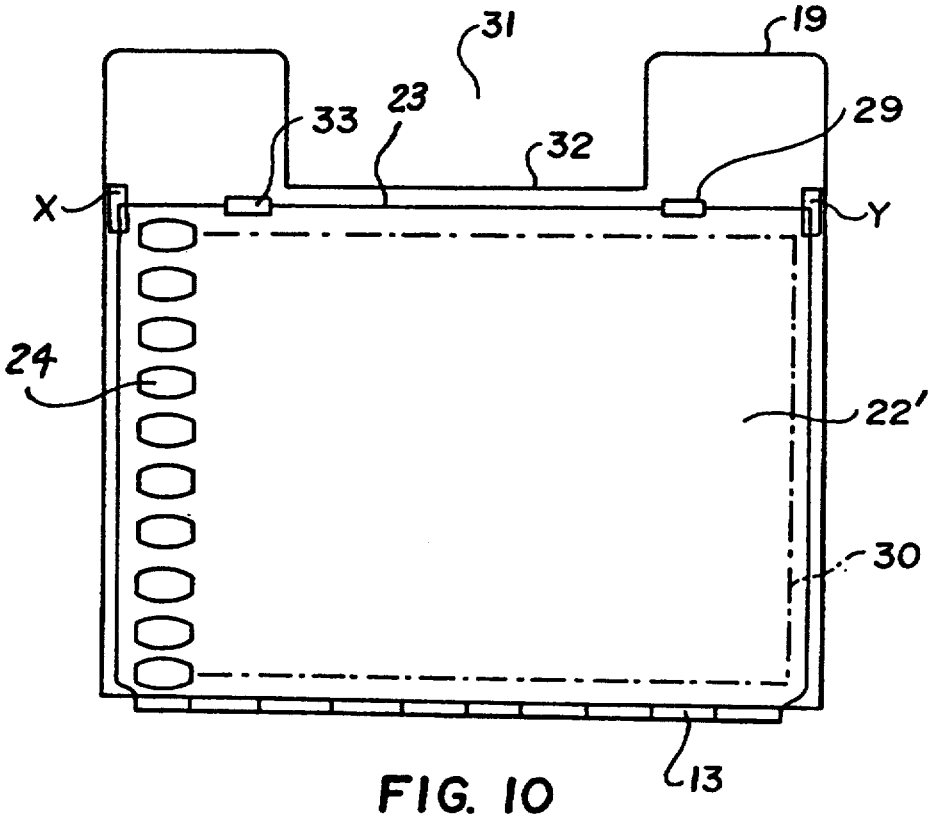
FIG. 10 is a view in the general direction of arrows 10—10 in FIG. 9, but with the lids together.

As seen with reference to FIGS. 9 and 10, plastic wall A comprises a body 21 having a front edge 23 and places 24 for pill insertion. Likewise, plastic wall B comprises a body 22 having a front edge 25, and places 26 for pill insertion. FIG. 10 shows front edges 23 and 25 held tight to each other by the use of snaps 33, 29. A clear plastic piece 27 attaches to plastic wall B close to the latter's connection to hinge 13. Piece 27 cooperates with plastic wall B to create a space C that can hold certain flat medications such as skin patches, as well as holding notes, cards, and my Medical Passport.

FIG. 10 shows the view when the box is open and the plastic walls A and B are in their place inside upper lid 2. Snaps X and Y, which are connected to upper lid 2, hold plastic walls A and B in place. The locations of pill places 24, 26 are along the left side, and a space 22' for my Medical Chart is to the right of the pill places. Snaps 29, 33 that hold plastic walls A and B together tight are shown along edges 23, 25. A broken line 30 shows the outline of the very narrow space 22' between the two plastic walls A and B which is designed to hold my Medical Chart inside it. My Medical Chart is a piece of thick paper or plastic that has color bands along side the pill spaces and directions for the pills written on them. Upper lid 2 has a cut-out space 31 providing clearance for cassette recorder 47 when the upper lid is closed. The front facing edge 32 of space 31 is in the middle of upper lid 2.

Figure 11:
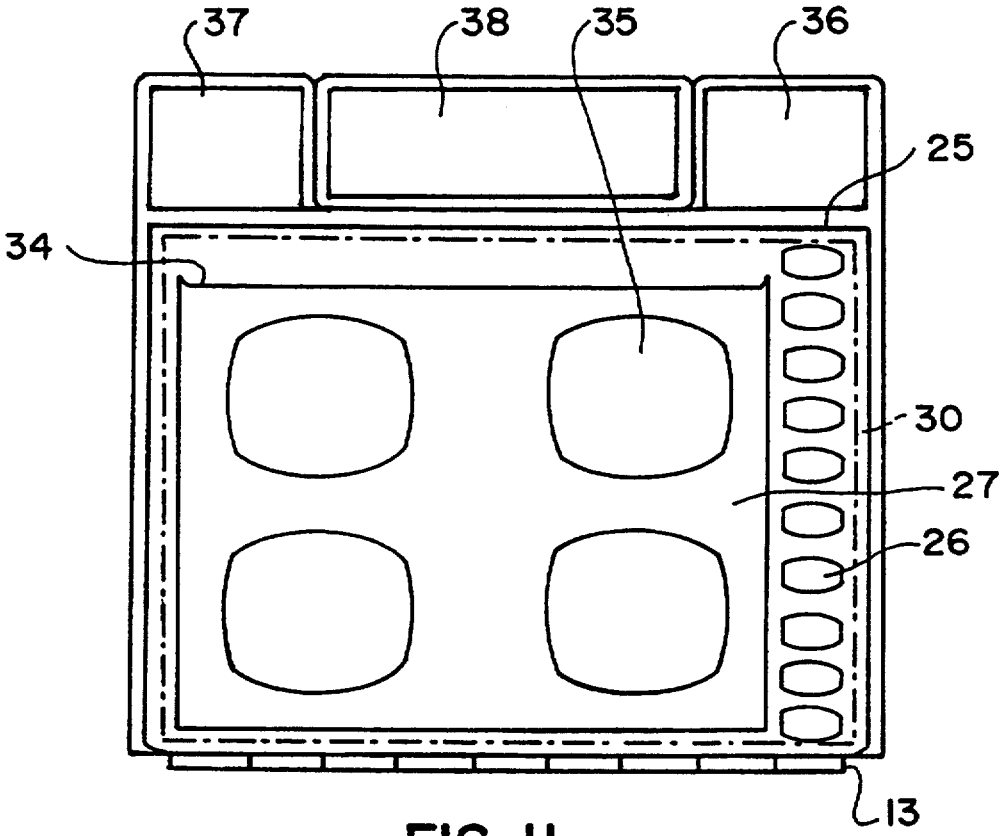
FIG. 11 is a view looking in the direction of arrows 11—11 in FIG. 9.

FIG. 11 is a view looking toward the upper surface of plastic wall 27 when closed onto body 1 of the box. With snaps 29 and 33 holding walls A and B together along front edges 25 and 23, and with walls A and B being hinged via hinge 13 along opposite edges, it should be appreciated that the snapped-together walls A and B form an inner lid that can be swung open and closed on body 1, as suggested by FIG. 9. As should also be appreciated, this inner lid will fit into, and swing open and closed in unison with outer lid 2 when the two lids are held together by means of snaps X and Y. When snaps 29, 33 are unsnapped, walls A and B can open, as in FIG. 9, to allow access to spaces 24, 26, 22. When walls A and B are closed together, spaces 24, 26 create a home for pills that have been placed therein and space 22' creates a home for my Medical Chart that has been placed therein. Medical Chart has colored lines, bands, and directions correlated with the pills. Piece 27 is clear plastic and contains a hole 35 that allows one's fingers to go inside to help remove the things from space C. The numeral 34 shows the front edge of piece 27 and the opening of space C is next to it.

Figure 12:
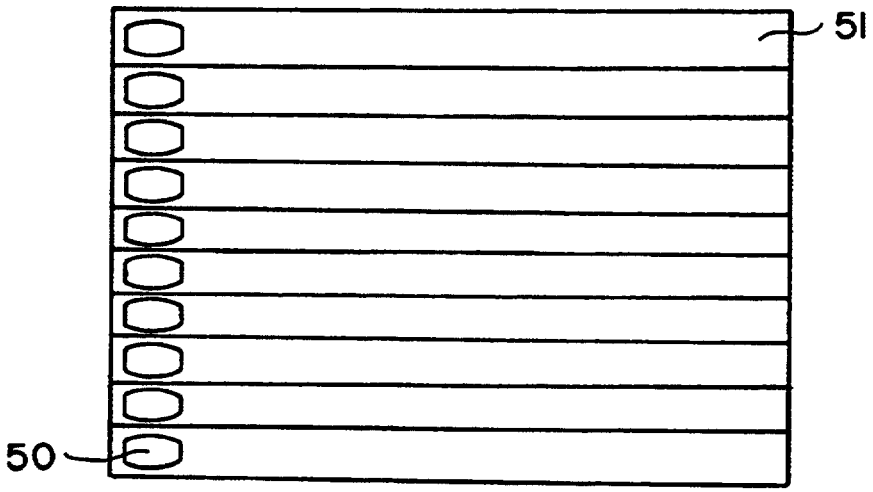
FIG. 12 is a top plan view of a medical chart by itself, the medical chart being used in association with the inner lid.

FIG. 12 shows the general arrangement of my Medical Chart which is made from a relatively thick and heavy paper or plastic that has perforated areas 50 which will stay between pill spaces 24 and 26 to allow them to be connected to each other. Along side each perforated area 50 there is a colored band area, such as one shown by 51. Each can be colored one color, such as red, blue, yellow, pink, etc., or combinations thereof. In the center of each colored band there is space to have the name and purpose and directions of the medication to be written and specified such as "Lanoxin—Heart Pill, one tablet a day." This chart will stay in place between walls A and B as shown by broken line 30. It can be taped with a small piece of adhesive tape to prevent it from moving.

Figure 13:
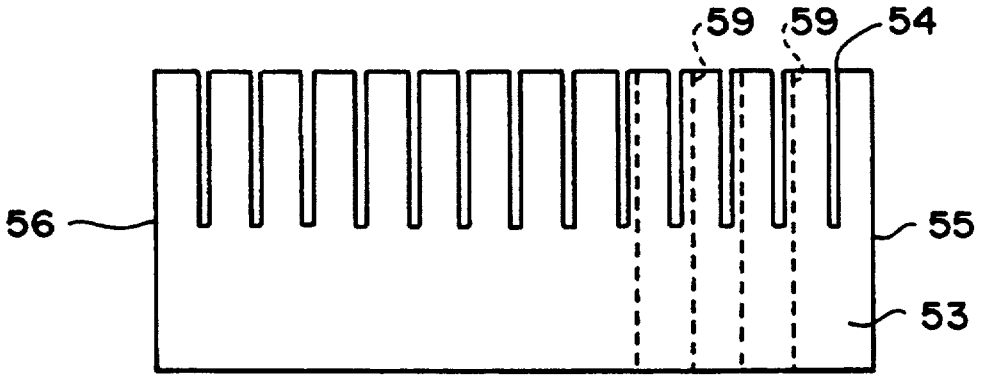
FIG. 13 is an elevational view of an internal dividing wall that is used in the main body of the medical box.

FIG. 13 shows a long dividing wall which fits between slots 46 and 45 in FIG. 7. Naturally, to divide the box into many small places many of these dividing walls are needed, and are provided. Numeral 53 shows the solid part of the dividing wall, and numeral 54 shows cuts that allow other smaller dividing walls (shown in FIG. 14) to sit inside it. The broken line 59 shows thin lines that allow the wall to be cut shorter in order to allow the spaces between the walls to be larger.

Figure 14:
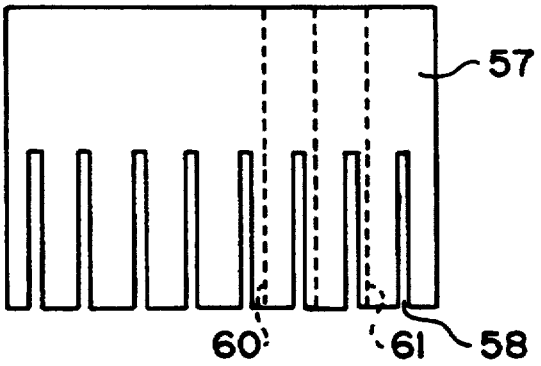
FIG. 14 is an elevational view of another internal dividing wall that is used in the main body of the medical box.
Figure 15:
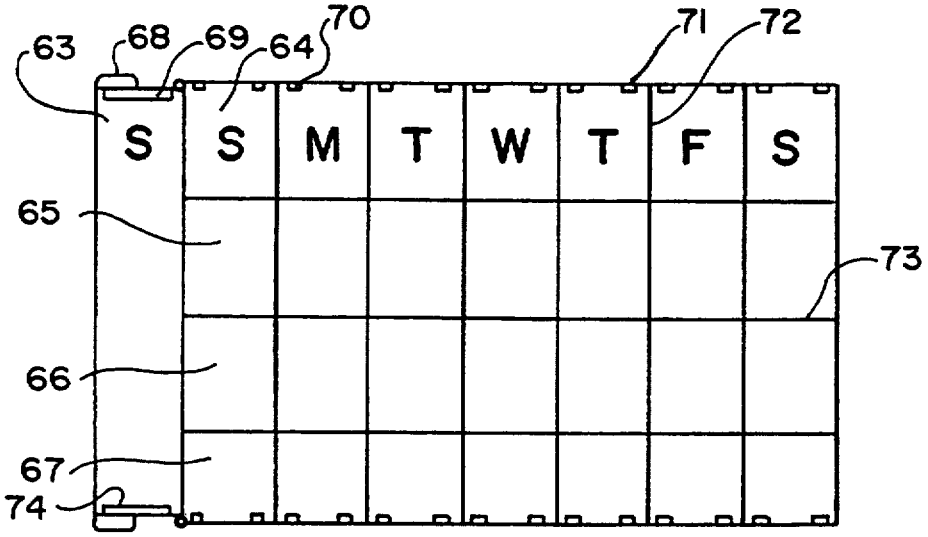
FIG. 15 is a top plan view of a weekly pill container box that fits inside the medical box, the doors having been removed for illustrative purposes.

FIG. 14 shows a short dividing wall which fits between slots 43 and 44 (FIG. 7) from front to back. Again, to divide the box into many small places there will be many of these short dividing walls. Numeral 57 shows the solid part, and numeral 58 shows cuts that allow the larger walls (shown in FIG. 13) to sit inside it. The broken line number 60 shows thin lines that allow the wall to be cut shorter in order to allow the spaces between the walls to be larger.

FIGS. 15–22 show the weekly pill container 90. It comprises twenty-eight boxes arranged as four rows of seven columns. The short walls 72 divide the container into the seven columns, and the long walls 73, into the four rows. The upper row as viewed in FIG. 15 has initials of the days of the week, S for Sunday, M for Monday, etc. The upper row is for medications to be taken in the mornings, the next row for medications to be taken at noon, the next row for medications to be taken afternoons or evenings, and the final row for medications to be taken evenings. The boxes of the final row are smaller than the others because less medications are usually taken in the evenings.

Doors are associated with the columns as follows. A door S for the Sunday column, a door SM for the Sunday-Monday column, a door MT for the Monday-Tuesday column, a door TW for the Tuesday-Wednesday column, a door WT for the Wednesday-Thursday column, a door TF for the Thursday-Friday column, and a door FS for the Friday-Saturday column.

Figure 16:
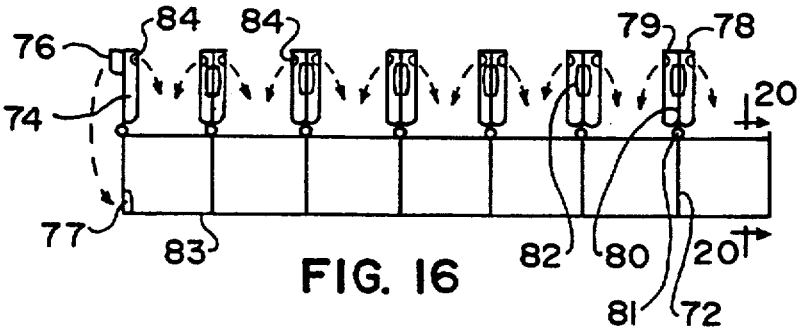
FIG. 16 is a front elevational view of the weekly pill container box showing the doors in open positions.
Figure 17:
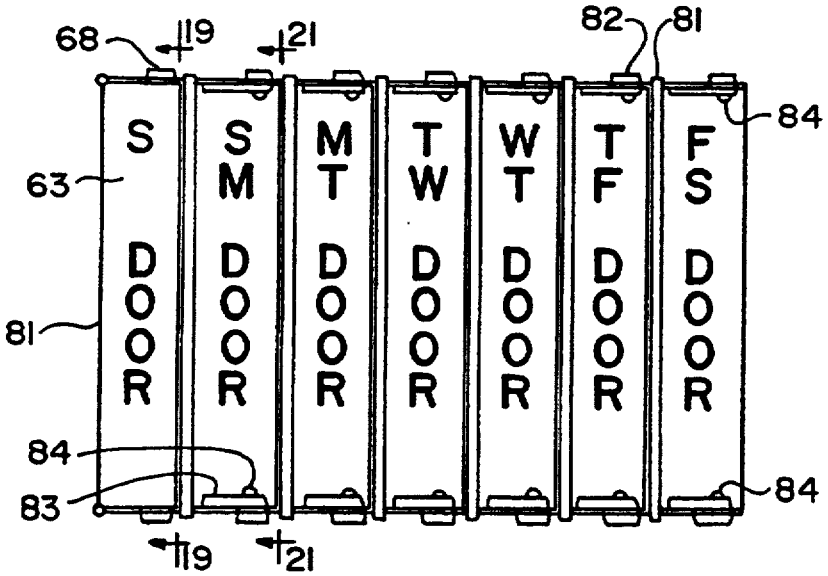
FIG. 17 is a top plan view of the weekly pill container box with the doors in closed positions.

Each door is attached to container 90 by a respective hinge 81 along its left-hand edge as viewed in FIG. 17, which shows each door S, SM, MT, TW, WT, TF, FS closed on a corresponding column. FIG. 16 shows that the doors can be opened by swinging them counterclockwise as viewed in that Figure. Each door 68 has a little handle 82 that helps the door to be pulled from its closed position. Each such handle projects from the body 80 of the door along an edge of the body that extends perpendicularly from the edge connected to hinge 81.

Each door also has wall structure for engaging the container to assist in holding the door in a particular position. This wall structure is identical for all doors except door S. This wall structure of door S comprises plastic walls 69, 74 that fit inside the Sunday column when door S is closed. The walls 69, 74 contain indentations 84 for engagement with indentations 71 on the container for holding walls 69, 74 in place on the container so as to prevent the free opening of door S when closed on the Sunday column. On the face of door S opposite the face that contains walls 69 and 74 is a tiny plastic wall 76 that goes over an indentation 77 in the lower corner of the container to hold door S against the outside of the container when the door is swung 270 degrees counterclockwise from the closed position, as will be explained more fully later on.

The wall structure for assisting in holding the six other hinged doors on the container in particular positions comprises walls 78 on one face and walls 79 on the opposite face. These tiny plastic walls 78, 79 are for fitting into the columns of the container on each side of the corresponding hinge, as will be explained more fully later on. They also have indentations 84 for engagement with indentations 70, 71 in the wall of the container columns.

The twenty-eight boxes are filled with medications for the week and each door is closed on a corresponding column, door S closing the first S column, the door SM closing the M column, the MT door closing the first T column, the TW door closing the W column, the WT door closing the second T column, the TF door closing the F column, and the FS door closing the second S column. On Sunday morning, the patient opens door S to expose the four Sunday boxes 64, 65, 66, and 67 containing the Sunday medications for the four different times of day mentioned. Door S can be fully swung open and stuck against the outside of the left side of the container, leaving all Sunday medications uncovered.

Figure 18:
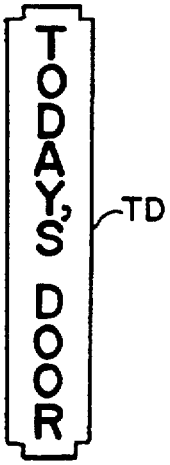
FIG. 18 is a top plan view of an extra door by itself that is used with the weekly pill container box.
Figure 19:
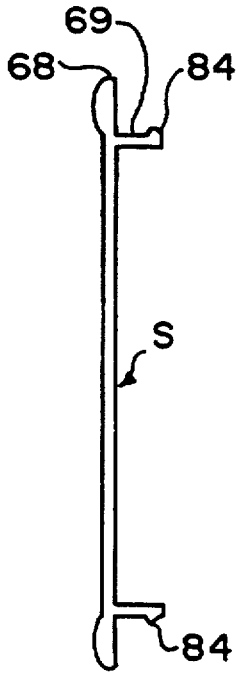
FIG. 19 is a view of one of the doors by itself as taken along line 19—19 in FIG. 17.
Figure 20:
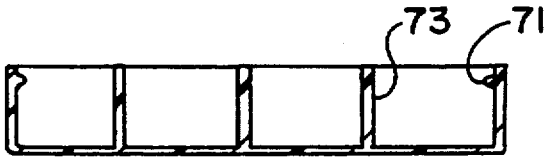
FIG. 20 is a cross-sectional view as taken along line 20—20 in FIG. 16.
Figure 21:
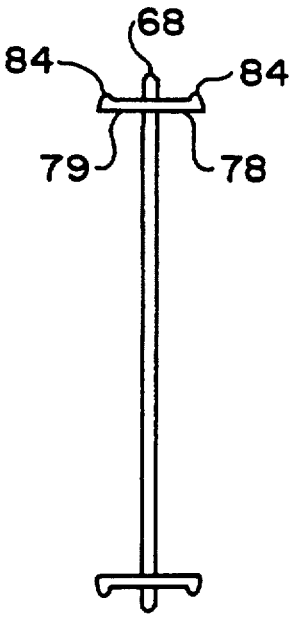
FIG. 21 is a view of another of the doors by itself as taken along line 21—21 in FIG. 17.
Figure 22:
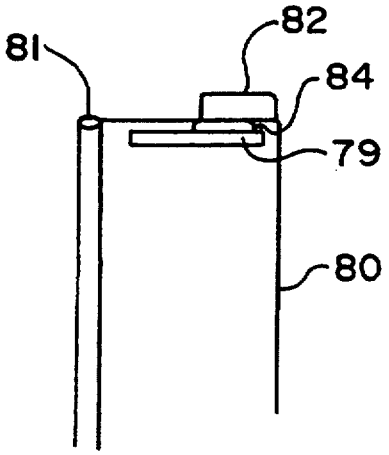
FIG. 22 is an enlarged fragmentary view showing additional detail relevant to the door of FIG. 21.

A special door TD, called Today's Door, is provided as a separate universal part that can be used to close any open column of the container. FIG. 18 shows door TD by itself.

Weekly pill container 90 is intended to open only one day's medications at a time. Thus, when the patient opens door S, only the Sunday medications are exposed. If desired, such as when the container is being transported, the special door TD is used to close the open Sunday column.

On Monday morning, the Sunday medications have been taken so that boxes 64, 65, 66, and 67 are empty. Assuming that special door TD is not being used, and that door S has been fully opened and stuck against the outside of the container, the first S column is open. The door SM is also closing column M at this time. Now, if door SM is swung 180 degrees counterclockwise as viewed in FIG. 16, it will be closed on the Sunday column and will open the Monday column to expose the Monday medications.

This procedure may be repeated with successive doors on successive days until the Saturday medications have been taken. In this way only the medications for a particular day are exposed at any time, subject to the possibility of closing the open column by using door TD, as desired. Thus, the weekly pill container allows only one day's medications to be open at a time, unless the patient ignores directions. The weekly pill container allows the patient easy access to medications for one day and helps to prevent confusion. If the patient has to go somewhere and/or wants to close that day's medications, the special door TD is fitted to the open column for that day.

It is intended that each door contains a title for the particular day's medications that it is covering. Thus, the face of the Sunday door that is seen when it is covering the Sunday column contains the writing "Sunday Medications". The other doors are correspondingly identified in similar fashion. The special door is marked with the writing "Today's Door" and in this regard will have a special color. The back face of each door may have a special color or mark so that when it is seen closing a column whose medications have already been taken, it will provide a signal of that to the patient so that the patient will not open it.

The weekly pill container is made from a flat plastic box of 22 by 13 by 2.2 cm. This will allow it to fit inside the medical box in the manner of FIG. 23, sitting on two small horizontal plastic walls 91, 92 attached to the inside of the medical box. In this way, the weekly pill container can occupy a space above medicine bottles 94 in the bottom of the medical box and below the inner lid formed by walls A and B. Slight construction adjustments can be done easily to allow the weekly pill container to be placed inside the medicine box, such as making space C smaller. The corners of the small boxes for the pills will be curved to allow the pills to be removed easily and the space to be cleaned easily. When each hinge-connected door is closing the column on the right of its hinge as viewed in FIG. 16, the walls 69, 74, 78 with their indentations 84 are engaging with the indentations 71 of the columns to hold the doors closed. When the doors are swung counterclockwise, the six doors on the right cover the six columns that are to the left of their hinges as viewed in FIG. 16 with their walls 79 and indentations 84 on walls 79 engaging with indentations 70 to keep the doors closed. The left-most door SD uses walls 76 to engage indentations 77 to hold it open against the outside of the container.

Figure 23:
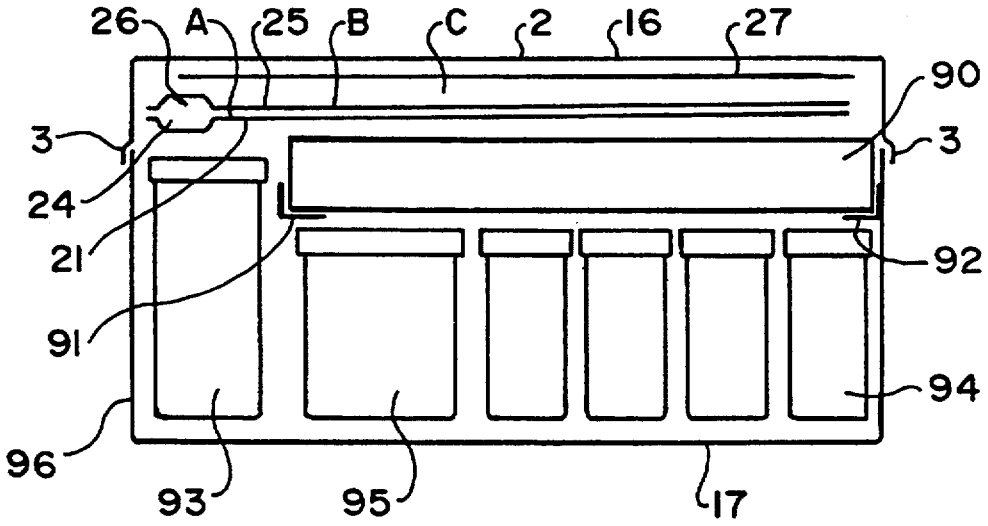
FIG. 23 is a vertical cross-sectional view through the medical box from the front to show the organization and arrangement of various parts when the medical box is used and the lids are closed.
Figure 24:
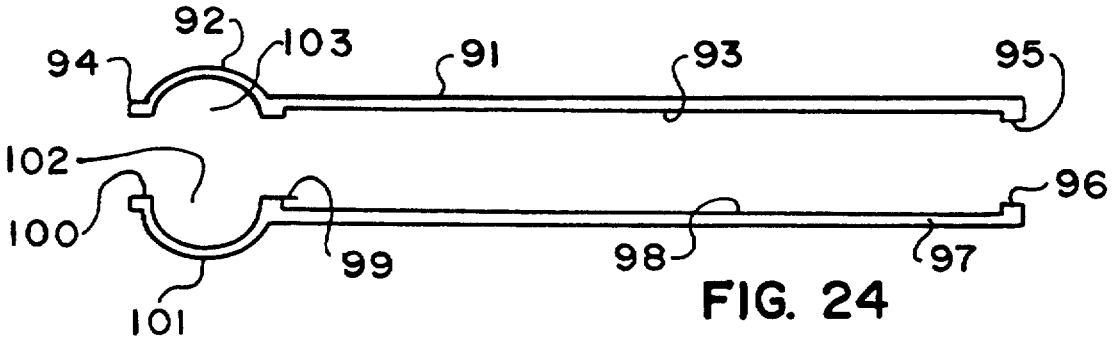
FIG. 24 is a cross section through a pill sample illustrator (PSI) with the two parts separated.
Figure 25:
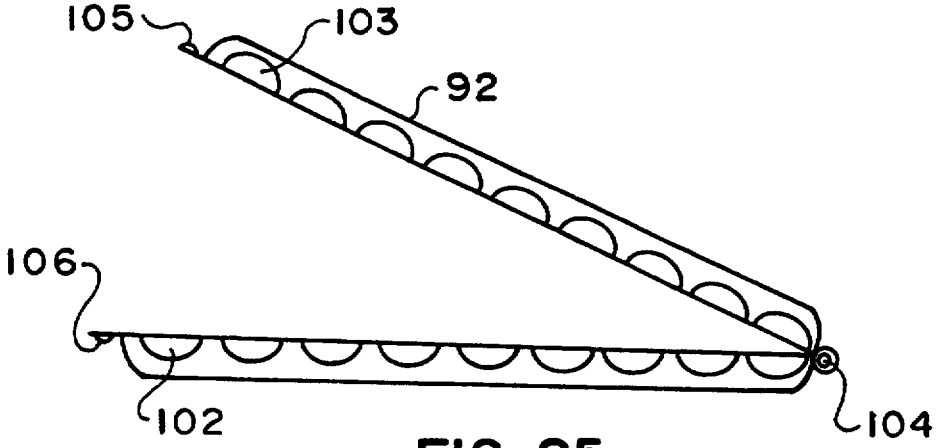
FIG. 25 is a side view of the PSI.
Figure 26:
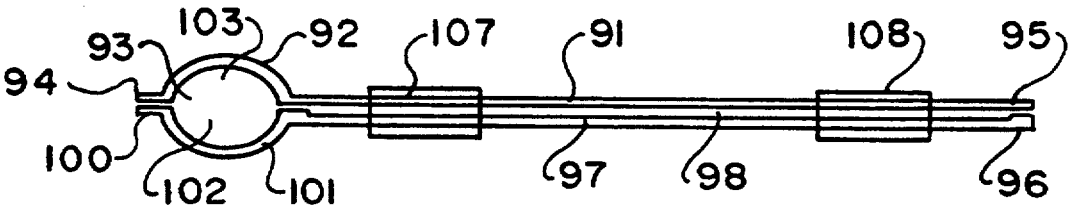
FIG. 26 is a front view of the PSI.
Figure 27:
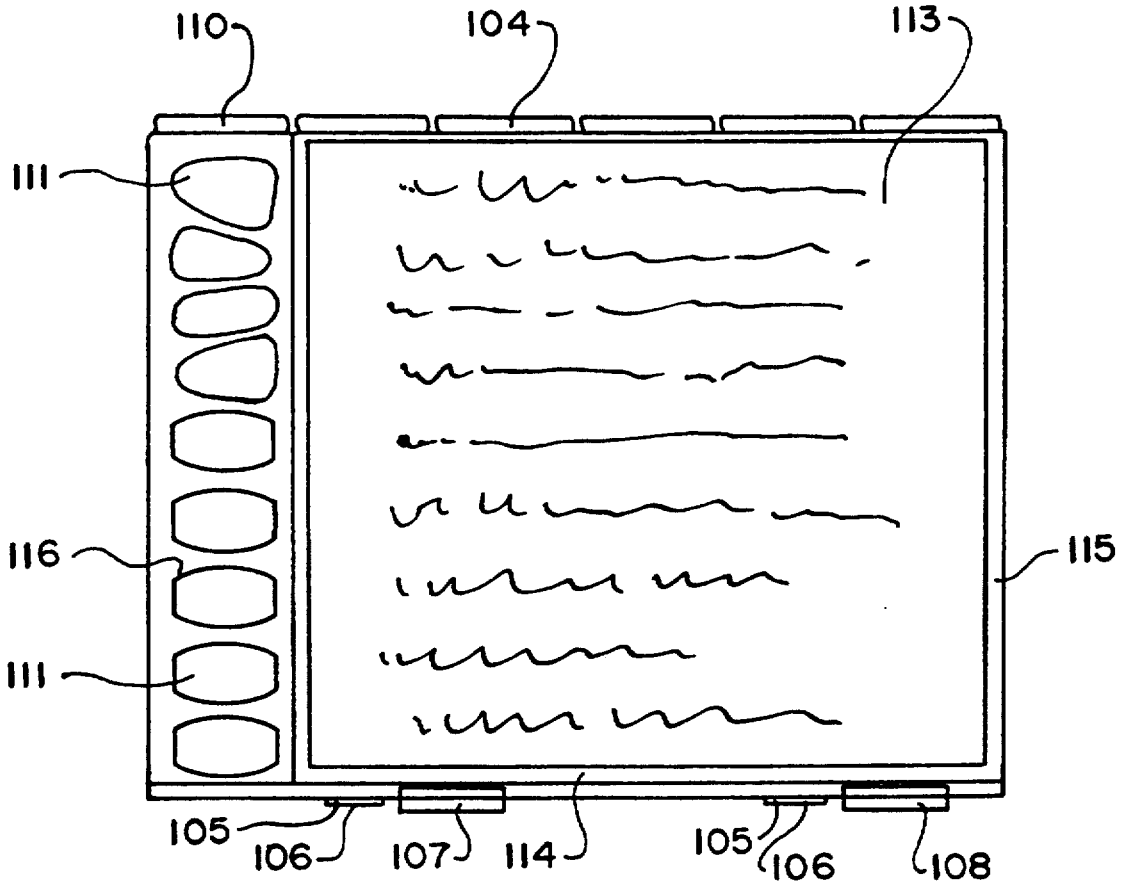
FIG. 27 is a top view of the PSI.

FIG. 23 shows the arrangement of the contents of the medical box when both the upper lid 2 and the inner lid (walls A and B) are closed. The weekly pill container 90 is supported in overlying relationship to shorter pill bottles 94, 95, the latter pill bottle being wider than the former bottles. The weekly pill container is not in overlying relation to a taller pill bottle 93. The medical box is made of plastic materials, and the inside of the bottom contains a soft layer of sponge to allow the medication bottles to sit easily on it. The main body of the medical box is divided by long and short dividing walls (FIGS. 13 and 14) into small spaces. These dividing walls are about 1.5 to 2 mm thick and their ends fit into vertical depressions, or slots, in the walls of the body of the box, as explained earlier. There are many such slots to allow the spaces to be adjusted easily when necessary. The upper lid 2 has a clear plastic window for insertion of papers. Inside the upper lid is the inner lid consisting of walls A and B together. As mentioned earlier, this inner lid is to hold pills and my Medical Chart. New directions can be written on paper which has adhesive on its back for gluing over old ones when needed. The inner lid also provides the space C for my Medical Passport, or other notes, directions, information health or appointments, or medications such as patches, etc. In the front of the medical box is the space for the cassette recorder to be inserted. The cassette recorder can be permanently fixed or removable. The cassette recorder will operate with a battery and will have space for an electric charger to be used too. The cassette recorder will allow a patient to record medical advice and orders given to him or her by medical staff at the time of the doctor's office visit, and the patient can also have the orders about medications, directions, etc., to be nicely recorded by the familiar voice of his or her own family members. The patient can then listen whenever and as many times as he or she may want about recommendations for the medications.

The medical box may have a handle (not shown) in the top to be held. It may have space to hold cassette tapes. The spaces in the front corners next to the cassette recorder may be used for emergency medications such as Nitroglycerine tablets where it could be accessed conveniently. The buttons of the cassette recorder may be conveniently colored for patient use, and directions may be printed on its front.

The upper lid and the sides of the main body of the box have windows for insertion of a thick piece of paper that can contain directions or a picture of a person or another thing such as a nice painting, etc.

In order to make the daily use of medications easy for the patient and to eliminate the need for the patient to open the box each time for taking a medicine out of a bottle, the weekly pill container 90 is designed to hold the medications of one week in separate boxes. There is a column of four boxes for holding each day's medications.

This invention is based on a very useful device that I believe that I am the first to design: a box that has clear windows in its sides and its top for insertion of photos or written materials, directions, etc., to give ease of reading and visualizing them without need for opening the box, and it may also have a record player fixed to its wall to allow tapes to be conveniently listened to. It also has a space for insertion of other materials such as books, cassette tapes, food, tools, etc. This box has many uses, for example a lunch box that has clear windows for a child's own picture, name, and classroom, as well as other pictures he or she may wish to insert. In such case, there may be no need for a cassette recorder. Although a cassette recorder may be used very effectively in case the parent wants the child to do something, and he or she did not have time to explain. The cassette recorder can be used for both recording as well as listening. It has a place for the use of earphones in conditions where noise is a problem. The box has many uses, for example a person can have educational tapes inside the box as well as related booklets in its top lid and with a chart which tells which tapes have what material, all in one piece. This will allow a person to choose and listen to the tapes, any place he or she wishes to use. Another use can be imagined when papers and directions for someone are to be left for another to come and use when shifts change. This kind of briefcase will allow the person to leave them inside it and to dictate all the directions and the second person to come and listen to the tape and pick up the related papers and materials much more conveniently. Therefore, briefcases can be made with use of this technique to allow this convenient invention to be used. A lunch box with cassette tape recorder can be used very nicely by the parents that want their child to hear their voice and message later, for one reason or another.

Various forms of sheet metal, such as those already mentioned, can be inserted into the spaces behind the windows. The windows in the box are shown rectangular in shape and made of clear plastic. There are very narrow walls in three sides to connect to the box leaving one side open for insertion of the sheet material into the narrow space thus defined. A closure may be used to close the open side after the sheet material has been inserted into the space. Such a closure may be a zipper or plastic which has a cross cut like a wedge so that the thinner edge of the wedge can be inserted into the open side, and even glued in order to seal the open side when there is a need to permanently close it after insertion of the sheet material.

When the box is used as a medical box, the pill bottles stored in the bottom of the box have unique colors. The color of each bottle is also displayed in the band extending from the corresponding pill in the pill space in the inner lid of the box.

FIGS. 24–27 show a Pill Sample Illustrator (here abbreviated and referred as PSI). It has an upper wall 91 and the roof 92 of the pill places of this wall. The space 103 for the pill sample is to the left side 94. The space 93 for a medical chart is to the right side. The lower wall 97 is almost a mirror image of upper wall 91. The place for a medical chart is 98; the place for the pill is 101; the empty space for a pill is 102, the right side is 96, and the left side is 100. Indentations 99 hold the medicine chart in place to prevent it from slipping out of its place. The hinge 104, and the free ends, that will be held together by indentations 105, 106, will allow hard covers 107, 108 to go over and hold them together. Spaces 111 are where the pills will be placed. Wall 116 is between these spaces. 113 is the narrow flat space where the medicine chart will be placed, no 115 is the right side edge opposite to the side that holds the pills, 114 is the front edge opposite to the hinge.

Figure 28:
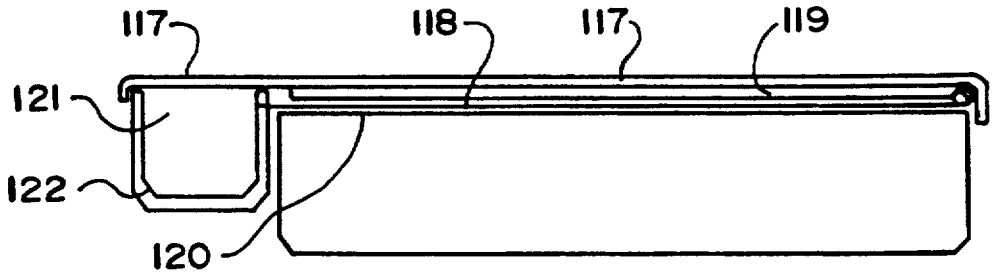
FIG. 28 is a front view showing a slightly modified PSI as a lid for a box.

FIG. 28 shows a weekly medicine box with a PSI lid in place on the top. Space for individual pills on the left are 121. The upper edge of the bottom box is 120, the upper wall of the PSI is 117; the lower plastic wall of the PSI is 118, and the space between them for holding the medicine chart is 119.

Figure 29:
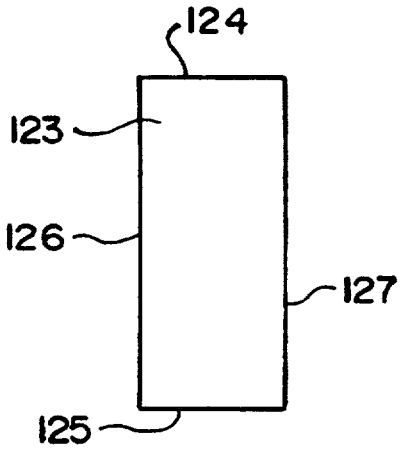
FIGS. 29, 30, and 31 are enlarged top, side, and front views of a compartment of the box.
Figure 30:
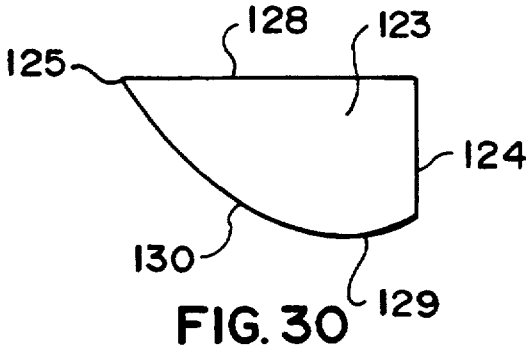
Figure 31:
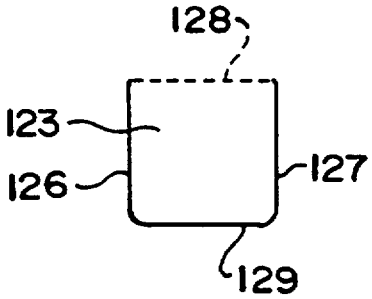

FIGS. 29–31 show one of the twenty-eight individual small boxes, or pill compartments, that holds the medication of one time such as morning dose, noon dose, etc... 124 is an edge close to the hinge of the big box (the weekly medicine box). 125 is an edge close to the front of the box. 126 is the left side of this box and 127 is the right side of this box. 123 is the inside of this box where the pills will be placed. The bottom surface of this box has a curve like a ski slope starting from the front part going down to the end and then to its rear wall, which is closer to the hinge side. The upper rim of the box is 128, the mid-part of the bottom surface is 130, and the lowest part of the bottom surface is 129. The space inside the box is 123.

Figure 32:
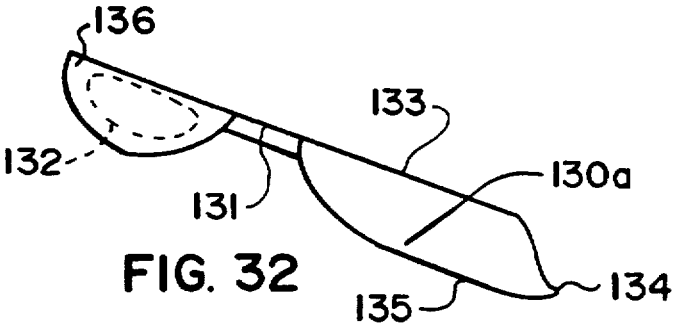
FIGS. 32 and 33 are side and top views of a scoop for removing contents from the compartment.
Figure 33:
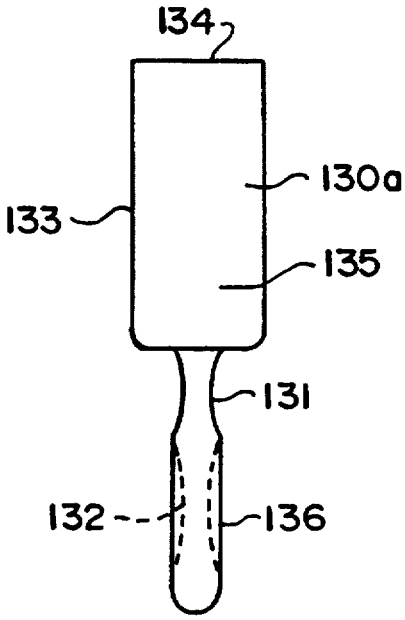

FIGS. 32 and 33 show a scoop for picking up pills from the small compartments. A handle 136 comprises a central indented concave finger 132. The indentations are to allow the fingers to hold the scoop easily. The front edge is 134, the upper edge of right side wall is 133, the bottom surface is 135, and the inside space of it is 130*a*. A short neck 131 is between the handle and the empty space of the scoop.

Figure 34:
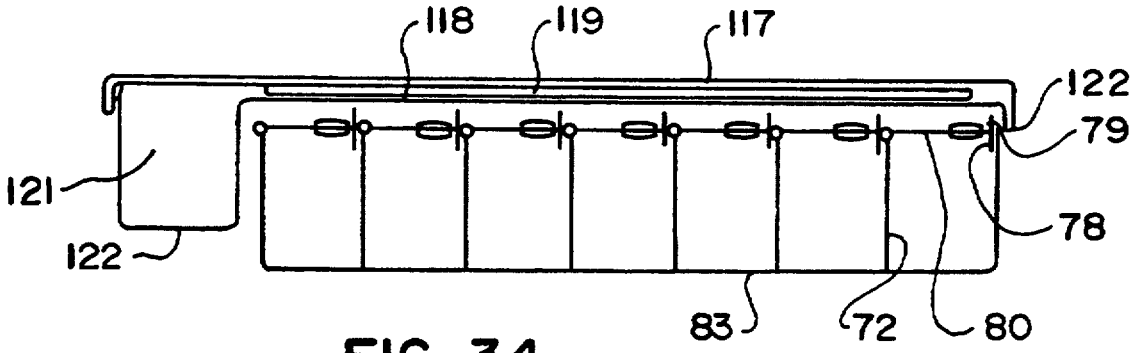
FIG. 34 is a view similar to FIG. 28 showing more detail.

FIG. 34 shows a weekly medicine box having a lid as in FIG. 28. This lid is covering a box that has individual small doors similar to the one's shown in my previous application. FIG. 34 shows how the lid covers all the small doors and will secure the whole box. The place for samples of the pills are completely out of the way and placed to the left side as shown. The top of the lid (sheet A) is 117, the bottom (lower sheet B) is 118, and the space between them for medical chart is 119. The place for holding the samples of the pills is 121, and the rim of the lid is 122. The bottom of the box is 83, the wall is 72, the small doors are 80; the pieces 78 and 79 and a hinge 81 are also shown.

Figures 35, 36:
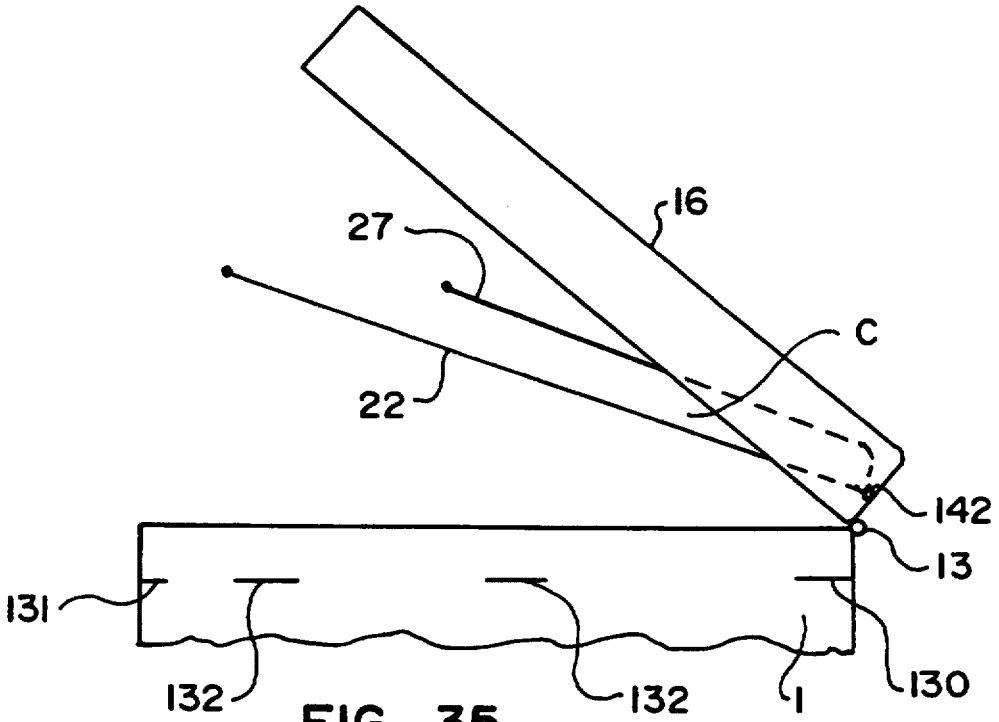
FIG. 35 is a side view showing more detail.
FIG. 36 is a view of a front face of my Medical Chart.

FIG. 35 illustrates a Medicine box similar to the one mentioned in my previous application that is modified to use the weekly medicine box too. This is to change the plastic walls so that only one plastic wall 22 will be present with its own piece 27 to make the space C. This plastic piece is connected to the lid of the main box at 142 and then it can be held securely inside the lid by the use of small snaps (under 16). The body of main box 1 will have small walls or indentations 130, 132 and 131. (These are similar to the walls 92 and 91 from FIG. 23 of the previous application) so that it will make a sitting place for the weekly medicine box to be placed over them and then the upper lid can be closed.

FIG. 36 shows the medicine chart. The pills and the directions are on the front face. It also shows what happens in certain medications such as the one at 134 where the medicine (Questran) is a powder (This medicine comes in a can or packets.) and naturally cannot be placed inside the small pill places. However, the name of the medicine can be placed in one empty place inside a small matching plastic (shown in FIGS. 39–41) which will be provided and the name of medicine can be placed inside it. This will be like a small clear plastic peanut that can be opened in half to allow the name to be stuck to it and then be closed. This piece will match the place for the pills so that it will prevent the name from being rolled over. The same will be true about insulin.

Figure 37:
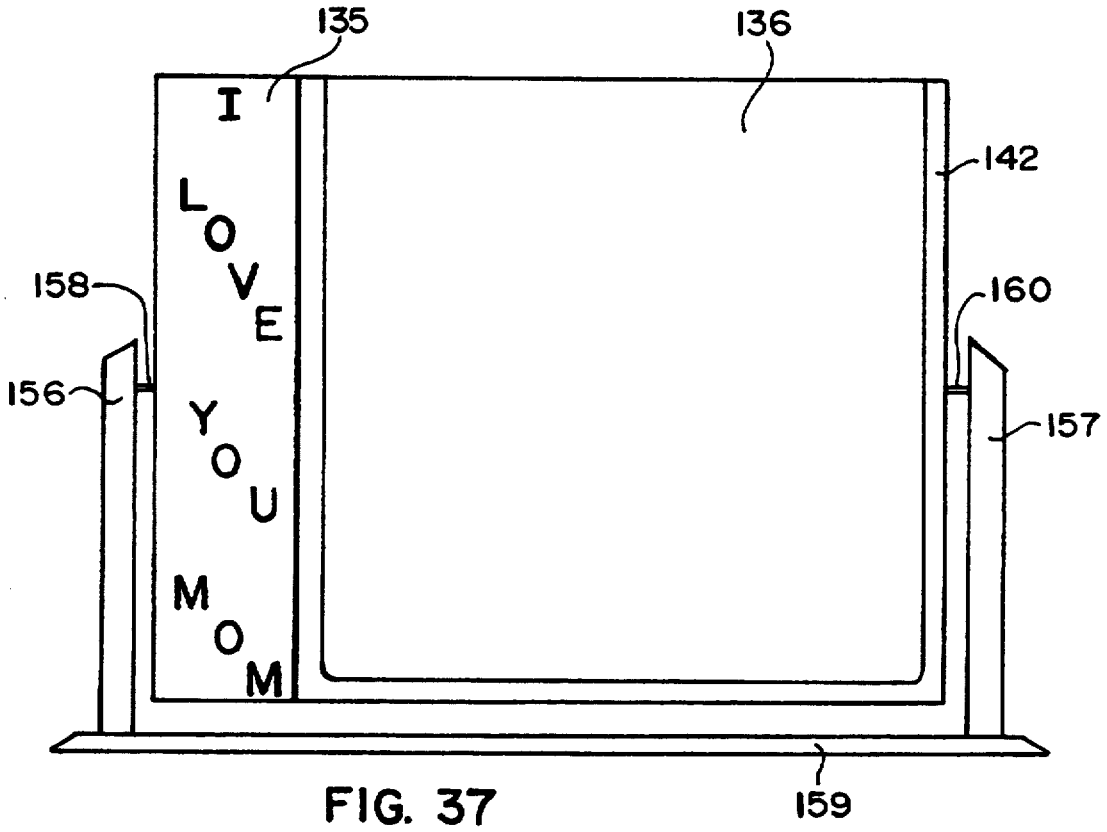
FIG. 37 is a front elevational view of another embodiment.

FIG. 37 shows the front view of a medicine chart that has a place for a message and a place for pictures. It can be held in place on a base 159 that has two poles 156, 157, one in each side, by being hinged at 158 and 160 to the poles allowing it to rotate around the hinges.

Figure 38:
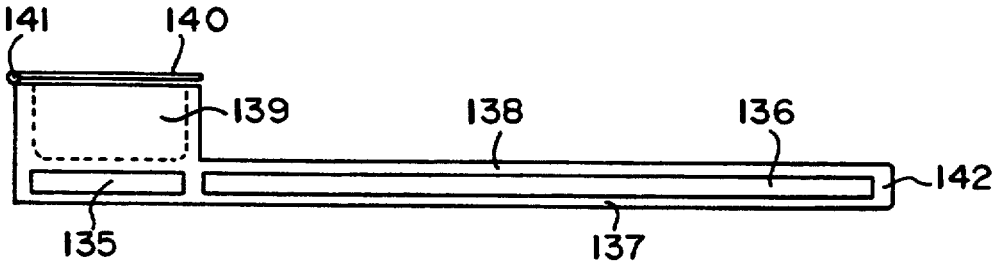
FIG. 38 is a top edge view of FIG. 37.

FIG. 38 shows a PSI that has a place for a message in the left at 135 behind pill places 139. The pill places will be covered by a clear cover 140 hinged to the body of the unit at 141. The medicine chart as well as the picture of the person will be placed at 136, and both 137 and 138 are clear plastics that will allow easy visualization of those pieces.

Figure 39:
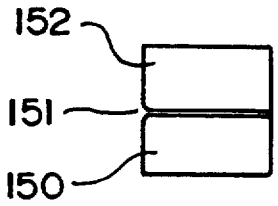
FIGS. 39, 40, and 41 are different views of an article for simulating a non-pill sample as a pill.
Figure 40:
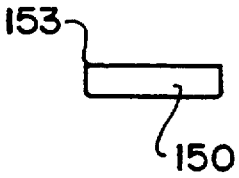
Figure 41:
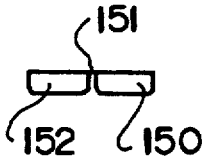

FIGS. 39–41 show two small plastics 152 and 150, each one like half of a peanut, that are hinged together at 151. This will allow a small paper to be stuck to one surface 150 and the other to cover it. The piece 150 is shown with the surface 153 that will allow the paper to stick.

Figure 42:
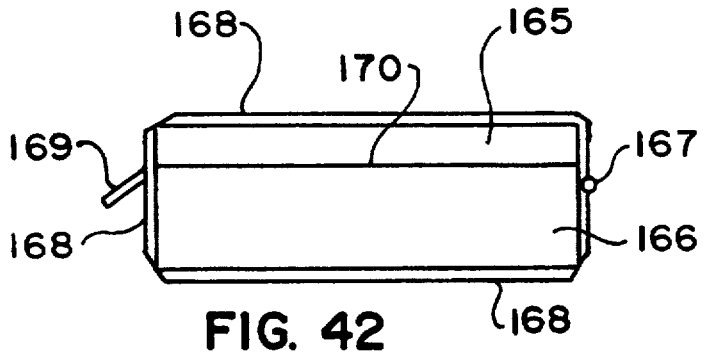
FIGS. 42 and 43 are side and front views of one form of fastening means.
Figure 43:
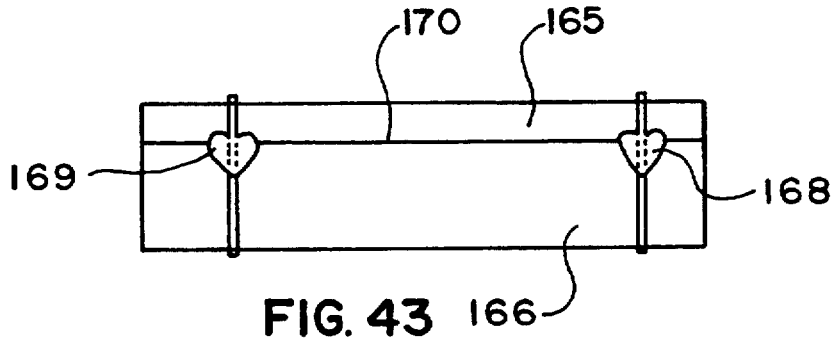

FIGS. 42 and 43 show a weekly medicine box and how a rubber band can go around the box to hold the upper and the bottom parts tight next to each other. 165 is the lid and the 166 is the body of the box, and 170 is the lower rim of the lid. Here the rubber band 168 is connected to the back at point 167, and goes around the box and a small plastic of 169 helps to hold it to be pulled.

Figure 44:
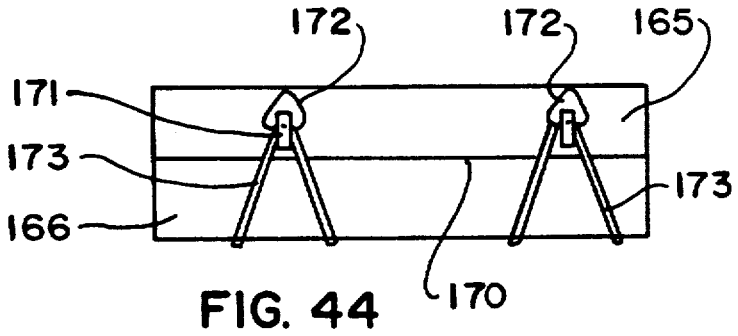
FIGS. 44, 45, 46, and 47 are various views of another form of fastening means.
Figure 45:
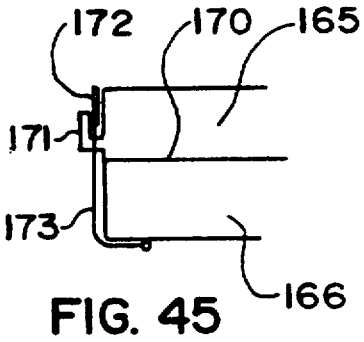

In FIGS. 44 and 45, a rubber band 173 is connected to the bottom and pulled by the small plastics 172 and is held in place over a hook 171.

Figure 46:
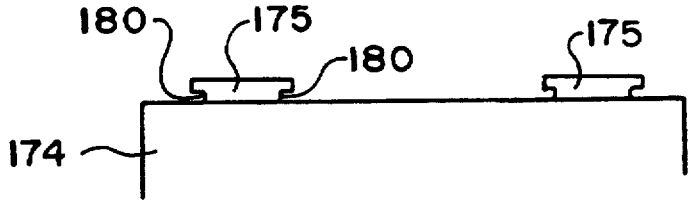
Figure 47:
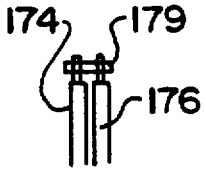
Figure 48:
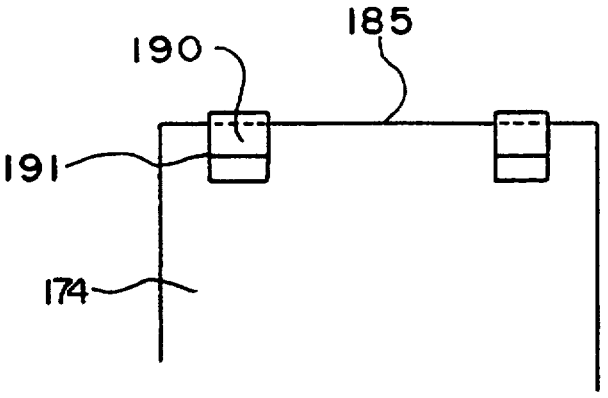
FIGS. 48 and 49 are two views of still another fastening means.
Figure 49:
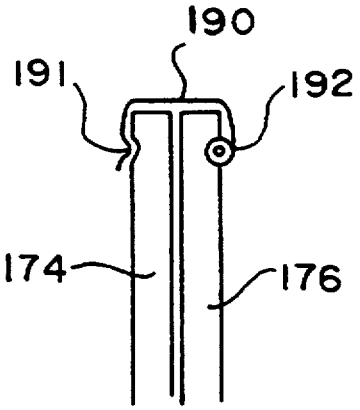

FIGS. 46 and 47 show the front of a PSI 174 having two indentations 175 in its top with notches 180 in both sides which allow a rubber band 179 to go around them. The two walls of PSI are 174 and 176.

This invention makes a single useful entity from a basic idea which was mentioned in my previous application: combinations of two pieces of transparent plastics hinged to each other to make spaces in between to hold samples of medications as well as a sheet of paper with their directions. Then it shows that with the combination of other parts together, most of them explained in my previous application, a very useful weekly medicine box can be made to be used alone.

The PSI has multiple small spaces, each of which can hold a pill sample, and for each sample the medical chart has a band of colored area which has information about that particular pill typed or written on it. The size of these spaces may be bigger on the lower side than the upper and their shapes may vary to allow different pills to be placed. There is a narrow rectangular space between the lower plastic wall B, 97, and the upper plastic wall A, 91, which can hold one or two rectangular pieces of thick paper. One of these papers will be referred as "medical chart", shown in my previous application. This chart is a thick piece of paper or plastic with bands and lines of different colors 51, each alongside a pill space in order to help the patient to associate each pill with information written on the paper about the name and directions and other vital information about that pill. When the medication or dosage is changed, then the new information can be typed or written on a smaller size matching colored sticker stuck instead or over the old one. A space in the middle of each colored band may be left white for information with an arrow to point to that particular pill.

The medical chart may be made from a thin rectangular plastic with a glossy surface that is covered already with different colored bands to allow stickers with information to be removably adhered to its surface in order to be exchanged when needed. The back of this chart may also have spaces for certain important information, such as the phone numbers of important relatives, the doctors, emergency phone numbers, etc.

Also, there will be enough space for insertion of another page behind the medical chart. This page can be a picture of the person or another page of information of any form such as important telephone numbers, and the room number of a patient in a nursing home, etc. The information may be written on a sticker removably stuck to the back of the medical chart. A few small indentations of plastic, such as one shown in FIG. 24 by 99, will help the pictures and the medical chart to stay in place more easily. I would like to mention that the size of the pill spaces and also the place for the medical chart may be unequal in each plastic wall 97, 91, even to a degree of non-existence in one wall and the whole space in the other.

With slight modification, a unit can be made that on one side (one face) it will hold the medication samples and directions, and on the other side (the reverse face) it will hold the picture of a person next to a message. The rear side of the pill place will have a space for insertion of a long paper with the message on it: for example, "I love you, mom[ signed by a daughter, etc. A matching base can be used to hold this unit in place, like a picture frame. FIGS. 37 and 38 show one such example, and also this figure shows importantly a version where the place which holds the medical chart and the picture can be a separate and to be a sealed place with only one opening along one side. The opening of the space for insertion of the papers can be closed by a matching plastic wedge temporarily or with use of glue permanently. This combination will allow this unit to be used on one side as an interesting picture place with a message in the side, then to be turned to show the pills with their names, directions and dosages, etc.

A sample of the given information in the medical chart is shown in FIG. 36. Naturally, when the background is colorful and the message is typed, it will look much more appealing. However, something which is important enough to be mentioned is that I have included the medication that cannot be inserted inside those small spaces; such as Questran powder and also Insulin.

The PSI can be used to make a lid for the weekly medicine box. The bottom part of this box can be a flat matching box made from plastic of about 22*13*2.4 cm (the size may vary). It will be divided into twenty-eight small boxes by six vertical and three horizontal walls. This box can also be similar to the one of my previous application, having individual doors for each day's medications.

The lid is made from plastic hinged to the side of the box and modified to cover the box including its small doors. In this case, the place that holds the samples of the pills will be basically made only in the lower plastic B, and will stay at the side of the body of the box when the lid is closed. The part that holds the pills will be basically the same as before shown in my previous application. The box will be made from clear or colored plastic with the prototype having a size of about 22*13*2.4 cm. The box will have vertical and horizontal lines to divide it into twenty-eight smaller boxes for insertion of the medication with seven boxes in four rows. One new feature that may be used in some models is that the small boxes have a shape in that their bottom that tapers down similar to a ski slope in order to allow the special small scoop to be used for picking up the medication from each box easily.

Another new feature is to help older patients having problems with using their fingers (due to arthritis, nerve or muscle problems) to open this box easily. Therefore, the handles of the boxes will be large to help in this way: one handle will be in the upper lid and one in the bottom box. Also, the box will be closed either by the use of the body of the box (to prevent it from being lost) and then it will hold the door of the box closed either by going around it or it can be stuck to the sides of the box and be pulled to come from the bottom to go over a hook or hooks made on the lid. Also, small pieces of magnets may be used in the corners of the boxes and its matching point on the lid to help it to be closed easily. Then these will be tightened by the rubber band, the snaps, or latches.

In cases when the patient needs more space for holding things such as Insulin syringes and related stuff and bottles, heart patches and eye drops, etc., that are not in pill form and the patient needs to carry them too, then an extra space will be made in the bottom of the box like a compartment that will have a door in front that can be opened for placement of those medications. Vertical as well as horizontal walls may be inserted inside the matching indentations to allow smaller spaces to be made. In this case, if the horizontal walls were used, horizontal spaces will be created, and if the vertical walls were used, vertical spaces will be created. The door of this compartment can be closed by one of the mechanism mentioned above. This will allow those patients to take all the medications they need in one single box and to enjoy this invention.

The lower wall of the box may have a clear window for the insertion of a thick piece of paper that can have information of different types, etc., as in my previous application.

A weekly medicine box, as mentioned above, can be incorporated with the medicine box which I introduced in my previous application 5. As a special medicine box, this is a box usually made from plastic similar to the lunch box of children. This box will have a space in the bottom allowing the patient to place her regular medication (inside the commonly used small bottles that the pharmacists use to put the one month medications of patients inside) inside it and then to place weekly medicine boxes mentioned here on the top of them to allow them to take advantage of them both. This box would be a plastic box of about a lunch box size in that inside its lid there will be a plastic wall that will be hinged to the inside of the upper lid. This wall will have a piece connected to it that makes a space C. This space C is to allow placement of the papers and related things such as that or heart patches as well as Medical Passport which is designed by myself and is a booklet about patients' medical information inside it. In the upper part of the body of the box, there will be small plastic walls 130, 131, 132 to allow the weekly medicine box to sit on them and be secure in place. The bottom of this big box will hold the usually utilized pill bottles and the weekly medicine box on the top of them over narrow walls connected to the walls of the big box 130, 131, 132. Some models may not have space C. The main box will have indentations in its wall coming from top to bottom to allow matching walls to be inserted inside it to divide the space to smaller spaces as described in previous application. This box will also have a clear window in the top and sides to allow insertion of thick papers temporarily or permanently, to be visualized easily, such as a picture of a patient or information about telephone numbers, or about medications, etc.

The medicine box explained above may also have a place in front or the side to insert a recorder either temporarily or permanently. This will be placed in the center of the front wall or may be even placed in the bottom of the box. It will give its distinct advantage to the user, to record and listen to medical advice and other messages, as well as other things he/she wants to hear.

I claim:

1. A pill sample illustrator comprising wall means defining both a pill sample-containing region and a pill information-conveying region, said pill sample-containing region comprising a plurality of individual pill-receiving compartments each of which is for enclosing a corresponding pill sample, and said pill information-conveying region comprising pill information-conveying means comprising a plurality of pill information zones each of which is disposed in association with an associated one of said compartments for conveying information about a pill sample disposed in the associated compartment, and wherein said pill sample-containing region of said wall means comprises transparent view means allowing the interior of each compartment to be viewed by an observer so that the observer can see a pill sample disposed therein, and wherein said pill information-conveying means is disposed such that information that it conveys can also be seen by an observer in association with the observer's observation of pill samples disposed in said compartments, characterized in that said wall means is generally rectangular in shape so as to have four sides, said compartments are arranged in a single row extending along the margin of a first of said four sides, said pill information zones comprise, for each compartment, a band containing information about a pill sample disposed in the corresponding compartment and extending immediately from the corresponding compartment parallel to a second and a third of said four sides across said wall means to a fourth of said four sides, such information including the name of the pill and the patient dosage, and each compartment and the corresponding band occupy substantially the full extent between said first and fourth sides such that there are no compartments between them along such extent, the pill sample illustration further including an associated pill box containing compartments organized by date and time for containing the actual dosages of pills to be taken at prescribed times, the pills of such actual dosages corresponding to the pill samples illustrated by the pill sample illustrator.

2. A pill sample illustrator as set forth in claim 1 in which said wall means comprises a first transparent wall that overlies both of said regions and that provides both said transparent view means allowing the interior of each compartment to be viewed by an observer and also a further transparent view means through which an observer can view said pill information-conveying means while also observing pill samples disposed in said compartments.

3. A pill sample illustrator as set forth in claim 2 in which said pill information-conveying means is disposed on a chart that is disposed for viewing by an observer through said further transparent view means.

4. A pill sample illustrator as set forth in claim 3 in which said wall means comprises a further transparent wall that cooperates with said first transparent wall to form said wall means, said further transparent wall being disposed in cooperation with said first transparent wall such that said compartments are rendered transparent from opposite sides and such that a compartment for said chart is also cooperatively defined.

5. A pill sample illustrator as set forth in claim 4 in which said compartment for said chart also contains additional information-conveying means in the form of a sheet of information-conveying material that can be viewed through said further transparent wall.

6. A pill sample illustrator as set forth in claim 1 in which said wall means comprises two transparent walls secured together to cooperatively define at least one of said two regions.

7. A pill sample illustrator as set forth in claim 6 in which said two transparent walls cooperatively define both of said regions.

8. A pill sample illustrator as set forth in claim 7 in which said two transparent wall means cooperatively define a compartment within which said pill information-conveying means is disposed.

9. A pill sample illustrator as set forth in claim 1 in which said compartments are cooperatively defined by two walls that are separably secured together.

10. A pill sample illustrator as set forth in claim 9 in which one of said two walls defines a greater volume of each of said compartments than the other of said walls.

11. A pill sample illustrator as set forth in claim 10 in which said other wall is transparent at least where it defines said compartments.

12. A pill sample illustrator comprising wall means defining both a pill sample containing region and a pill information conveying region, said pill sample containing region comprising a plurality of individual pill-receiving compartments each of which is for enclosing a corresponding pill sample, and said pill information conveying region comprising pill information conveying means comprising a plurality of pill information zones each of which is disposed in association with an associated one of said compartments for conveying information about a pill sample disposed in the associated compartment and wherein said pill sample containing region of said wall means comprises transparent view means allowing the interior of each compartment to be viewed by an observer so that the observer can see a pill sample disposed therein, and wherein said pill information conveying means is disposed such that information that it conveys can also be seen by an observer in association with the observer's observation of pill samples disposed in said compartments, and in which said pill sample illustrator is a lid of a box for containing a supply of pills including pills like those of the pill samples that are intended to be displayed in said compartments.

13. A pill sample illustrator and box combination as set forth in claim 12 in which said pill information conveying region is disposed in overlying relation to a top face of said box and said pill sample containing region is disposed adjacent a side face of said box when said pill information conveying region is disposed in overlying relation to said top face of said box.

14. A pill sample illustrator and box combination as set forth in claim 13 in which a hinge means hingedly mounts said pill sample illustrator on said box such that said pill sample illustrator can be swung to a position in which it allows access to said top face of said box.

15. A pill sample illustrator and box combination as set forth in claim 12 in which said pill sample illustrator comprises a compartment within which said pill information conveying means is disposed, said wall means comprising transparent view means through which an observer can observe said pill information containing means.

16. A pill sample illustrator and box combination as set forth in claim 12 including a further lid of said box disposed for cooperation with said box to enclose said pill sample illustrator when said pill sample illustrator and said further lid are closed on said box.

17. A pill sample illustrator and box combination as set forth in claim 16 in which said further lid comprises a transparent window means through which said pill sample illustrator can be seen when said pall sample illustrator and said further lid are closed on said box.

18. A pill sample illustrator and box combination as set forth in claim 12 in which said pill sample illustrator comprises plural transport members mounted on said box a hinge means for enabling said pill sample illustrator to swing on said box about an axis defined by said hinge means.

19. A pill sample illustrator comprising wall means defining both a pill sample containing region and a pill information conveying region, said pill sample containing region comprising a plurality individual pill-receiving compartments each of which is for enclosing a corresponding pill sample, and said pill information conveying region comprising pill information conveying means comprising a plurality of pill information zones each of which is disposed in association with an associated one of said compartments for conveying information about a pill sample disposed in the associated compartment, and wherein said pill sample containing region of said wall means comprises transparent view means allowing the interior of each compartment to be viewed by an observer so that the observer can see a pill sample disposed therein, and wherein said pill information conveying means is disposed such that information that it conveys can also be seen by an observer in association with the observer's observation of pill samples disposed in said compartments, characterized in that said wall means is generally rectangular in shape so as to have four sides, said compartments are arranged in a single row extending along the margin of a first of said four sides, said pill information zones comprise, for each compartment, a band containing information about a pill sample disposed in the corresponding compartment and extending immediately from the corresponding compartment parallel to a second and a third of said four sides across said wall means to a fourth of said four sides, and each compartment and the corresponding band occupy substantially the full extent between said first and fourth sides such that there are no compartments between them along such extent, and further including a pill sample disposed in one of said compartments wherein said pill sample is a simulation of medicine that does not come in pill form.

* * * * *